US008760476B2

(12) United States Patent
Yamato

(10) Patent No.: US 8,760,476 B2
(45) Date of Patent: Jun. 24, 2014

(54) LIQUID CRYSTAL DISPLAY DEVICES AND METHODS FOR DRIVING THE SAME

(75) Inventor: Asahi Yamato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1277 days.

(21) Appl. No.: 12/449,879

(22) PCT Filed: Feb. 28, 2008

(86) PCT No.: PCT/JP2008/053569

§ 371 (c)(1),
(2), (4) Date: Sep. 1, 2009

(87) PCT Pub. No.: WO2008/117623

PCT Pub. Date: Oct. 2, 2008

(65) Prior Publication Data

US 2010/0020110 A1 Jan. 28, 2010

(30) Foreign Application Priority Data

Mar. 28, 2007 (JP) ..... 2007-085928

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 5,347,294 | A | 9/1994 | Usui et al. | |
| 5,465,102 | A | 11/1995 | Usui et al. | |
| 5,844,533 | A | 12/1998 | Usui et al. | |
| 7,362,296 | B2 * | 4/2008 | Song et al. | 345/89 |
| 7,505,026 | B2 * | 3/2009 | Baba et al. | 345/102 |
| 7,907,155 | B2 | 3/2011 | Shiomi | |
| 2002/0044115 | A1 | 4/2002 | Jinda et al. | |
| 2002/0186192 | A1 * | 12/2002 | Maruoka et al. | 345/87 |
| 2003/0071939 | A1 | 4/2003 | Lazarev et al. | |
| 2003/0080932 | A1 | 5/2003 | Konno et al. | |
| 2003/0142118 | A1 * | 7/2003 | Funamoto et al. | 345/691 |
| 2004/0080517 | A1 * | 4/2004 | Song et al. | 345/596 |
| 2004/0246224 | A1 | 12/2004 | Tsai et al. | |
| 2005/0093803 | A1 * | 5/2005 | Cheon et al. | 345/92 |
| 2005/0162359 | A1 | 7/2005 | Sugino | |

(Continued)

FOREIGN PATENT DOCUMENTS

| | | |
|---|---|---|
| CN | 1643567 | 7/2005 |
| EP | 1 708 165 | 10/2006 |

(Continued)

OTHER PUBLICATIONS

Search Report dated Aug. 5, 2011 by the European Patent Office for corresponding European Patent Application No. 08721018.3.

*Primary Examiner* — Dorothy Harris
(74) *Attorney, Agent, or Firm* — Harness, Dickey & PIerce, PLC

(57) ABSTRACT

A high speed moving image processing section of a liquid crystal display device includes: a calculation section having a plurality of LUTs in accordance with which an output for performing overshoot drive is obtained with reference to current frame data and previous frame data; and a frame memory in which a video data signal of a previous frame is stored. During each writing period in a single frame period, the calculation section carries out data conversion for performing the overshoot drive by using a video data signal, transmitted from the host device, as current frame data, and by using a video data signal, read out from the frame memory, as pervious frame data. Further, an LUT for performing the overshoot drive is switched in every writing period.

1 Claim, 8 Drawing Sheets

(56) References Cited

U.S. PATENT DOCUMENTS

| | | | | |
|---|---|---|---|---|
| 2005/0259064 | A1* | 11/2005 | Sugino et al. | 345/102 |
| 2005/0275611 | A1 | 12/2005 | Aoki | |
| 2006/0022922 | A1 | 2/2006 | Jinda et al. | |
| 2006/0055661 | A1* | 3/2006 | Kawaguchi | 345/102 |
| 2006/0152476 | A1 | 7/2006 | Van Gorkom et al. | |
| 2006/0244705 | A1* | 11/2006 | Song et al. | 345/98 |
| 2007/0013630 | A1 | 1/2007 | Tsai et al. | |
| 2007/0273678 | A1* | 11/2007 | Okita et al. | 345/204 |
| 2008/0129672 | A1 | 6/2008 | Ishihara | |
| 2008/0211753 | A1 | 9/2008 | Tsai et al. | |
| 2010/0085492 | A1 | 4/2010 | Shiomi | |
| 2010/0164996 | A1* | 7/2010 | Tomizawa et al. | 345/690 |

FOREIGN PATENT DOCUMENTS

| | | | |
|---|---|---|---|
| JP | 4-318595 | | 11/1992 |
| JP | 2001-201763 | | 7/2001 |
| JP | 2002-116743 | | 4/2002 |
| JP | 2002-287700 | | 10/2002 |
| JP | 2003-131635 | | 5/2003 |
| JP | 2003-222902 | A | 8/2003 |
| JP | 2004-264725 | | 9/2004 |
| JP | 2004-317928 | | 11/2004 |
| JP | 2004-361943 | | 12/2004 |
| JP | 2005-181370 | | 7/2005 |
| JP | 2005-352315 | | 12/2005 |
| RU | 2226708 | | 4/2004 |
| WO | WO 03/079317 | | 9/2003 |
| WO | WO 03/098588 | | 11/2003 |
| WO | WO 2006/092977 | | 9/2006 |
| WO | WO 2006/095304 | | 9/2006 |
| WO | WO 2006/098244 | | 9/2006 |
| WO | WO 2007/018219 | | 2/2007 |
| WO | WO 2007018219 | A1 * | 2/2007 |

* cited by examiner

LIQUID CRYSTAL DISPLAY DEVICES AND METHODS FOR DRIVING THE SAME

TECHNICAL FIELD

The present invention relates to a liquid crystal display device, and particularly to a liquid crystal display device which can prevent a moving image from blurring in displaying the moving image.

BACKGROUND ART

Recently, liquid crystal display devices have been used in various devices having various sizes, e.g., in a television, a monitor, a mobile phone, and the like. While, a liquid crystal display device raises such a problem that an image blurs in displaying a moving image since its drive mode is a hold drive mode and response of liquid crystal is poor.

As an example of a technique for preventing the blurring image caused by the hold drive mode, black insertion display is known. The black insertion display is such that: a single frame is divided into plural sub frames, and pseudo impulse drive is performed in which at least one sub frame is set as a display period and at least other one sub frame is set as a black display period, so as to suppress the image from blurring.

In the black insertion display, ON/OFF of a backlight is controlled or black is written into a liquid crystal panel so as to carry out black display during a black display period. Recently, also a mobile device such as a mobile phone or the like is required to have a function for displaying a moving image. It is preferable to arrange the mobile device so that black insertion display is carried out by entirely controlling ON/OFF a backlight in order to simplify a device configuration and control means. Note that, it is general that the black insertion display means a method in which black display is inserted by writing black data into a liquid crystal panel. However, in this specification, a display method in which a black display period and an image display period are provided in a simple manner is referred to as "black insertion display", and also a method in which a black display period and an image display period are provided by controlling ON/OFF of the backlight is referred to as "black insertion display".

However, the liquid crystal display device has such a problem that response of liquid crystal is poor as described above, so that it is often that a moving image cannot be sufficiently prevented from blurring merely by carrying out the black insertion display. That is, in the black insertion display, writing into pixels is carried out during the black display period, but liquid crystal response caused by the writing has to be completed during the display period. However, writing into upper pixels of a display screen is carried out at the initial time of the black display period, so that a liquid crystal response period can be sufficiently obtained before the display period, but writing into lower pixels of the screen is carried out at the last time of the black display period, so that a period shifting to the display period is short, which results in incomplete liquid crystal response. This may cause the upper portion and the lower portion of the display screen to be different from each other in effect of suppression of blur of the moving image.

Patent Literature 1 discloses a liquid crystal driving method in which the black insertion display is carried out in combination with preliminary writing and overshoot drive so as to suppress blur of the moving image which blur cannot be prevented merely by the black insertion display.

In the liquid crystal driving method of Patent Literature 1, two writing operations, i.e., preliminary writing and regular writing are carried out during the black display period. Thus, it is possible to obtain a liquid crystal response period also in the lower pixels of the display screen by the preliminary writing which is carried out in the first half of the black display period.

Further, Patent Literature 1 discloses an arrangement in which overshoot drive is performed at the time of the preliminary writing so as to further enhance speed of the liquid crystal response. The overshoot drive is the following technique: If a direction in which a current gray scale changes to a gray scale to be displayed is a positive direction, a voltage higher than a writing voltage for the gray scale to be displayed is applied during a predetermined period, and if the direction in which the current gray scale changes to the gray scale to be displayed is a negative direction, a voltage lower than the writing voltage for the gray scale to be displayed is applied during a predetermined period, so as to promote a change of orientation of liquid crystal molecules, thereby enhancing a response property of liquid crystal. That is, in case of changing a first transmittance of a target pixel into a second transmittance higher than the first transmittance, a voltage higher than a writing voltage corresponding to the second transmittance is applied during a predetermined period.

CITATION LIST

Patent Literature 1

Japanese Patent Application Publication, Tokukai, No. 2001-201763 A (Publication Date: Jul. 27, 2001)

Patent Literature 2

Japanese Patent Application Publication, Tokukai, No. 2003-131635 A (Publication Date: May 9, 2003)

SUMMARY OF INVENTION

However, in the configuration of Patent Literature 1, two writing operations are carried out in a single frame, but the overshoot drive is performed only once at the time of the preliminary writing. Thus, response speed of liquid crystal is not sufficiently improved, so that it may be impossible to achieve a target luminance.

The present invention was made in view of the foregoing problem, and an object thereof is to realize drive which further enhances the response speed of liquid crystal in a liquid crystal display device which suppresses a moving image from blurring by carrying out the black insertion display.

In order to solve the foregoing problem, a liquid crystal display device according to the present invention carries out such display that a single frame period includes a black display period and an image display period and carries out writing into a liquid crystal panel n times ($n \geq 2$) during the single frame period, said liquid crystal display device comprising: a calculation section including a plurality of LUTs in accordance with which an output for performing overshoot drive is obtained with reference to current frame data and previous frame data; and a memory in which a video data signal of a previous frame is stored, wherein during each writing period in a single frame period, the calculation section carries out data conversion for performing the overshoot drive by using a video data signal, transmitted from a host device, as the current frame data, and by using the video data signal, read out from the memory, as the previous frame data, and the data conversion for performing the overshoot drive is carried out in accordance with an LUT which is switched in every writing period.

With the foregoing configuration, by carrying out such display that a single frame includes the black display period and the image display period, it is possible to suppress blur of the moving image which blur is caused by hold-type drive of the liquid crystal panel. Further, by carrying out the writing into the liquid crystal panel n times (n≥2) during a single frame period, it is possible to suppress blur of the moving image which blur is caused by poor liquid crystal response.

Further, by performing the overshoot drive in each writing period in the single frame period, it is possible to further suppress the blur of the moving image which blur is caused by poor liquid crystal response.

Here, in case of carrying out the writing into the liquid crystal panel n times in a single frame period, the following problem occurs: In performing the overshoot drive in each writing period, even if optimal overshoot drive can be performed in the first writing period, the liquid crystal is influenced in the second and subsequent writing periods by the previous writing operation, so that an orientation condition of the liquid crystal changes, which makes it impossible to perform optimal overshoot drive even in accordance with the same LUT. However, according to the foregoing configuration, the LUT is switched in every writing period, thereby determining an optimal applied voltage in every overshoot drive performed in every writing operation.

In order to solve the foregoing problem, another liquid crystal display device according to the present invention carries out such display that a single frame period includes a black display period and an image display period and carries out writing into a liquid crystal panel n times (n≥2) during the single frame period, said liquid crystal display device comprising: a calculation section including an LUT in accordance with which an output for performing overshoot drive is obtained with reference to current frame data and previous frame data; an estimation calculation section for estimating a gray scale of each pixel, which gray scale will be achieved after each writing period, based on the current frame data and the previous frame data; and a memory in which data calculated by the estimation calculation section is stored, wherein during each writing period in a single frame period, the calculation section carries out data conversion for performing the overshoot drive by using a video data signal, transmitted from a host device, as the current frame data, and by using a video data signal, read out from the memory, as the previous frame data, and the estimation calculation section estimates the gray scale by using the video data signal, transmitted from the host device, as the current frame data, and by using the video data signal, read out from the memory, as the previous frame data.

With the foregoing configuration, in the second and subsequent writing periods of the single frame, an influence exerted by the previous writing operation is estimated by the estimation calculation section, so that a video data signal of the previous frame which video data signal is stored in the memory is updated. Thus, even if the same LUT is used in the calculation section, it is possible to determine an optimal applied voltage in every overshoot drive performed in every writing operation.

In order to solve the foregoing problem, another liquid crystal display device according to the present invention carries out such display that a single frame period includes a black display period and an image display period and carries out writing into a liquid crystal panel n times (n≥2) during the single frame period, said liquid crystal display device comprising: a calculation section including a plurality of LUTs in accordance with which an output for performing overshoot drive is obtained with reference to current frame data and previous frame data; a first memory in which a video data signal of a current frame is stored; and a second memory in which a video data signal of a previous frame is stored, wherein during a first writing period in a single frame period, the calculation section carries out data conversion for performing the overshoot drive by using a video data signal, transmitted from a host device, as the current frame data, and by using the video data signal, read out from the first memory, as the previous frame data, and data read out from the first memory is stored into the second memory, and during second and subsequent writing periods in the single frame period, the calculation section carries out data conversion for performing the overshoot drive by using the video data signal, read out from the first memory, as the current frame data, and by using a video data signal, read out from the second memory, as the previous frame data, and the data conversion for performing the overshoot drive is carried out in accordance with an LUT which is switched in every writing period.

In order to solve the foregoing problem, another liquid crystal display device according to the present invention carries out such display that a single frame period includes a black display period and an image display period and carries out writing into a liquid crystal panel n times (n≥2) during the single frame period, said liquid crystal display device comprising: a calculation section including a plurality of LUTs in accordance with which an output for performing overshoot drive is obtained with reference to current frame data and previous frame data; a first memory in which a video data signal of a current frame is stored; and a second memory in which a video data signal of a previous frame is stored, wherein during each writing period in a single frame period, the calculation section carries out data conversion for performing the overshoot drive by using the video data signal, read out from the first memory, as the current frame data, and by using the video data signal, read out from the second memory, as the previous frame data, and the data conversion for performing the overshoot drive is carried out in accordance with an LUT which is switched in every writing period.

With the foregoing configuration, the LUT in the calculation section is switched in every writing period, so that it is possible to determine an optimal applied voltage in every overshoot drive performed in every writing operation. Further, the calculation is performed while the current frame data is stored in the first memory and the previous frame data is stored in the second memory, so that the host device has only to transmit video data to the liquid crystal display device once in a single frame, thereby avoiding increase of power consumption which is caused by high speed data transmission.

In order to solve the foregoing problem, another liquid crystal display device according to the present invention carries out such display that a single frame period includes a black display period and an image display period and carries out writing into a liquid crystal panel n times (n≥2) during the single frame period, said liquid crystal display device comprising: a calculation section including an LUT in accordance with which an output for performing overshoot drive is obtained with reference to current frame data and previous frame data; an estimation calculation section for estimating a gray scale of each pixel, which gray scale will be achieved after each writing period, based on the current frame data and the previous frame data; a first memory in which a video data signal of a current frame is stored; and a second memory in which data calculated by the estimation calculation section is stored, wherein during a first writing period in a single frame period, the calculation section carries out data conversion for performing the overshoot drive by using a video data signal, transmitted from a host device, as the current frame data, and by using the video data signal, read out from the first memory, as the previous frame data, and the estimation calculation section estimates the gray scale by using the video data signal, transmitted from the host device, as the current frame data, and by using the video data signal, read out from the first memory, as the previous frame data, and during second and subsequent writing periods in the single frame period, the calculation section carries out data conversion for performing the overshoot drive by using the video data signal, read out from the first memory, as the current frame data, and by using a video data signal, read out from the second memory, as the previous frame data, and the estimation calculation section estimates the gray scale by using the video data signal, read out from the first memory, as the current frame data, and by using the video data signal, read out from the second memory, as the previous frame data.

In order to solve the foregoing problem, another liquid crystal display device according to the present invention carries out such display that a single frame period includes a black display period and an image display period and carries out writing into a liquid crystal panel n times (n≥2) during the single frame period, said liquid crystal display device comprising: a calculation section including an LUT in accordance with which an output for performing overshoot drive is obtained with reference to current frame data and previous frame data; an estimation calculation section for estimating a gray scale of each pixel, which gray scale will be achieved after each writing period, based on the current frame data and the previous frame data; a first memory in which a video data signal of a current frame is stored; and a second memory in which data calculated by the estimation calculation section is stored, wherein during each writing period in a single frame period, the calculation section carries out data conversion for performing the overshoot drive by using the video data signal, read out from the first memory, as the current frame data, and by using a video data signal, read out from the second memory, as the previous frame data, and the estimation calculation section estimates the gray scale by using the video data signal, read out from the first memory, as the current frame data, and by using the video data signal, read out from the second memory, as the previous frame data.

With the foregoing configuration, in the second and subsequent writing periods of the single frame, an influence exerted by the previous writing operation is estimated by the estimation calculation section, so that video data of the previous frame which video data is stored in the memory is updated. Thus, even if the same LUT is used in the calculation section, it is possible to determine an optimal applied voltage in every overshoot drive performed in every writing operation. Further, the calculation is carried out while the current frame data is stored in the first memory and the previous frame data is stored in the second memory, so that the host device has only to transmit video data to the liquid crystal display device once in a single frame, thereby avoiding increase of power consumption which is caused by high speed data transmission.

Another liquid crystal display device according to the present invention carries out such display that a single frame period includes a black display period and an image display period and carries out writing into a liquid crystal panel n times (n≥2) during the single frame period, said liquid crystal display device comprising: a calculation section including an LUT in accordance with which an output for performing overshoot drive is obtained with reference to current frame data and previous frame data; an estimation calculation section for estimating video data which allows a desired gray scale value to be finally obtained in case where the overshoot drive is carried out by use of a single applied voltage in second to n-th writing operations; and a memory in which data calculated by the estimation calculation section is stored, wherein during a first writing period in a single frame period, the calculation section carries out data conversion for performing the overshoot drive by using a video data signal, transmitted from a host device, as the current frame data, and by using a video data signal, read out from the memory, as the previous frame data, and a video data signal obtained by the data conversion is outputted to the liquid crystal panel, and the estimation calculation section estimates the data by using the video data signal, transmitted from the host device, as the current frame data, and by using the video data signal, read out from the memory, as the previous frame data, so as to rewrite the data stored in the memory in accordance with a result of the calculation, and during second and subsequent writing periods in the single frame period, the video data signal read out from the memory is outputted to the liquid crystal panel.

With the foregoing configuration, in the first writing operation, optimal overshoot drive can be performed in accordance with data calculated by the calculation section, and in the second and subsequent writing operations, data which allows a desired gray scale value to be finally obtained is used to perform overshoot in case where overshoot drive is performed by using the same applied voltage in the second through n-th writing operations in accordance with data calculated by the estimation calculation section. Thus, it is possible to determine an optimal applied voltage in every overshoot drive performed in the writing operation.

DESCRIPTION OF EMBODIMENTS

Embodiment 1

One embodiment of the present invention is described below with reference to FIG. 1 through FIG. 9. First, with reference to FIG. 2, a schematic configuration of a liquid crystal display device according to Embodiment 1 is described.

Figure 2:
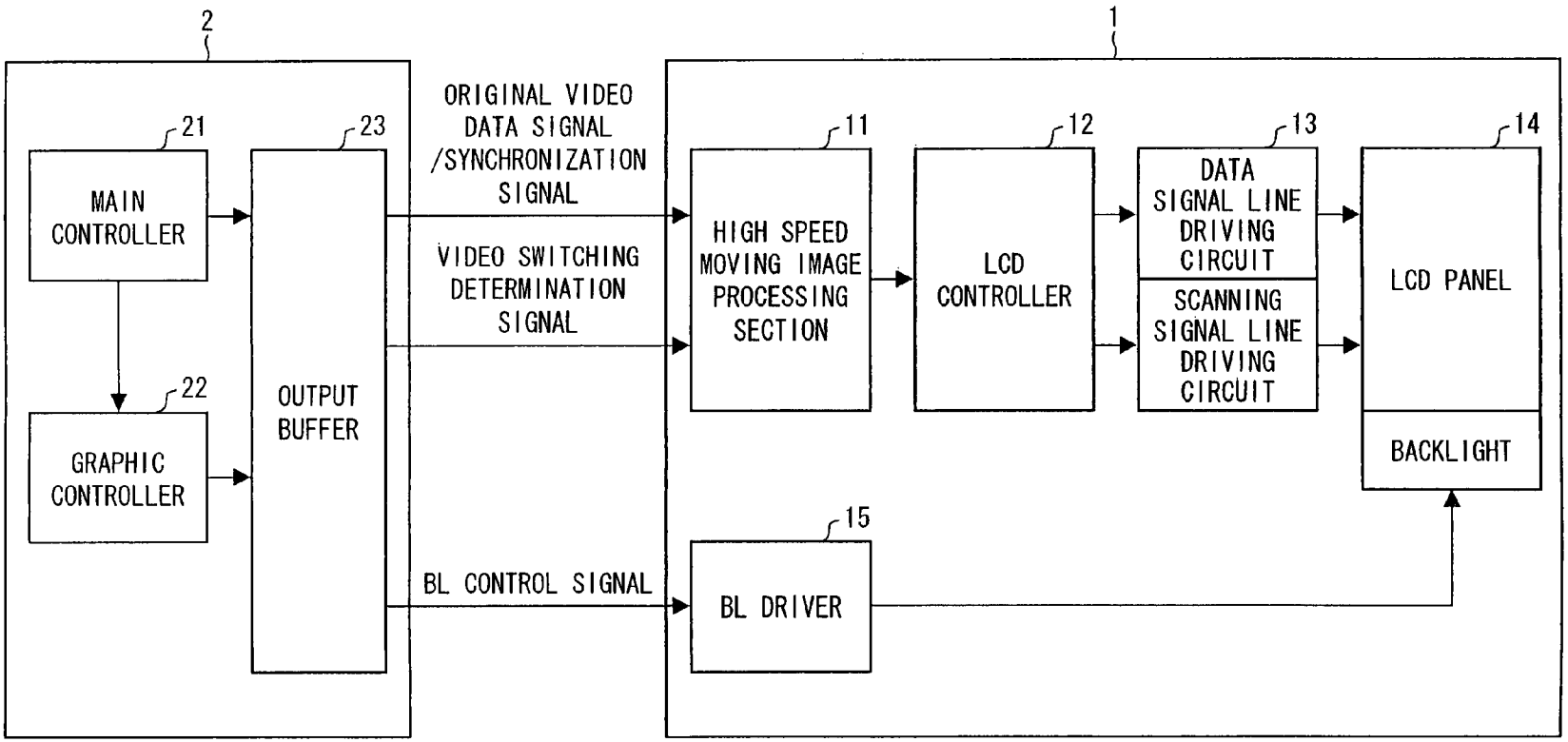
FIG. 2 is a block diagram schematically illustrating a liquid crystal display device to which the present invention is applied.

A liquid crystal display device 1 of FIG. 2 includes a high speed moving image processing section 11, an LCD (Liquid Crystal Display) controller 12, an LCD driver 13, an LCD panel 14, and a BL (Back Light) driver 15. Further, the liquid crystal display device 1 receives a video data signal and a display control signal, supplied from a host device 2, so as to display an image. Here, in case of applying the present invention to a mobile phone, a personal computer, or the like for example, the liquid crystal display device 1 is a liquid crystal display module, and the host device 2 is a CPU of the mobile phone, the personal computer, or the like.

The host device 2 outputs video data, generated by a graphic controller 22, via an output buffer 23 to the high speed moving image processing section 11 of the liquid crystal display device 1. The graphic controller 22 is controlled by a main controller 21. Further, the main controller 21 generates various kinds of control signals such as a synchronization signal, a video switching signal, a BL control signal, and the like, and outputs these control signals via the output buffer 23 to the liquid crystal display device 1.

The high speed moving image processing section 11 receives a video data signal, a synchronization signal, and a switching determination signal. The high speed moving image processing section 11 uses the video data signal, inputted from the host device 2, as original video data, and carries out a data conversion process with respect to the original video data so that the original video data is converted into video data suitable for the driving method according to the present embodiment. The video data converted by the high speed moving image processing section 11 is outputted via the LCD controller 12 to a data signal line driving circuit of the LCD driver 13. Further, the high speed moving image processing section 11 outputs control signals such as a clock signal, a synchronization signal, and the like via the LCD controller 12 to the data signal line driving circuit and a scanning line driving circuit of the LCD driver 13.

The LCD driver 13 includes the data signal line driving circuit and the scanning line driving circuit. The data signal line driving circuit receives the video data signal, converted by the high speed moving image processing section, and the control signals such as the clock signal, the synchronization signal, and the like. The data signal line driving circuit outputs the video data to each data signal line of the LCD panel 14 at a predetermined timing. The scanning signal line driving circuit receives control signals such as a start pulse signal, a clock signal, and a vertical synchronization signal, and the like. The scanning signal line driving circuit outputs a scanning signal to each scanning signal line of the LCD panel 14 at a predetermined timing.

The LCD panel 14 is driven by the scanning signal inputted from the scanning signal line driving circuit and the video data signal inputted from the data signal line driving circuit. Further, the LCD panel 14 includes a back light, and ON/OFF of the back light is controlled by the BL driver 15. In FIG. 2, the BL control signal is inputted from the main controller 21 of the host device 2 via the output buffer 23 to the BL driver 15.

In the liquid crystal display device 1, circuits such as the high speed moving image processing section 11, the LCD controller 12, the LCD driver 13, the BL driver 15, and the like can be partially or entirely large-scale integrated (LSI). Further, these large-scale integrated circuits can be formed on the LCD panel 14. Also, the main controller 21, the graphic controller 22, and the output buffer 23 of the host device 2 can be partially or entirely large-scale integrated LSI. Further, the BL control signal may be outputted not from the host device 2 but from the high speed moving image processing section 11.

Next, with reference to FIG. 1, the configuration and operation of the high speed moving image processing section 11 which is a characteristic portion of the present invention are detailed as follows. Note that, the high speed moving image processing section 11 according to Embodiment 1 provides a driving method suitable for suppression of blur of a moving image in displaying the moving image and carries out a driving method in which black insertion display, plural writing operations in the LCD panel 14 during a single frame period, and overshoot drive are performed in combination. More specifically, the characteristic point is such that the overshoot drive is performed in each of the plural writing operations carried out during a single frame period.

Figure 1:
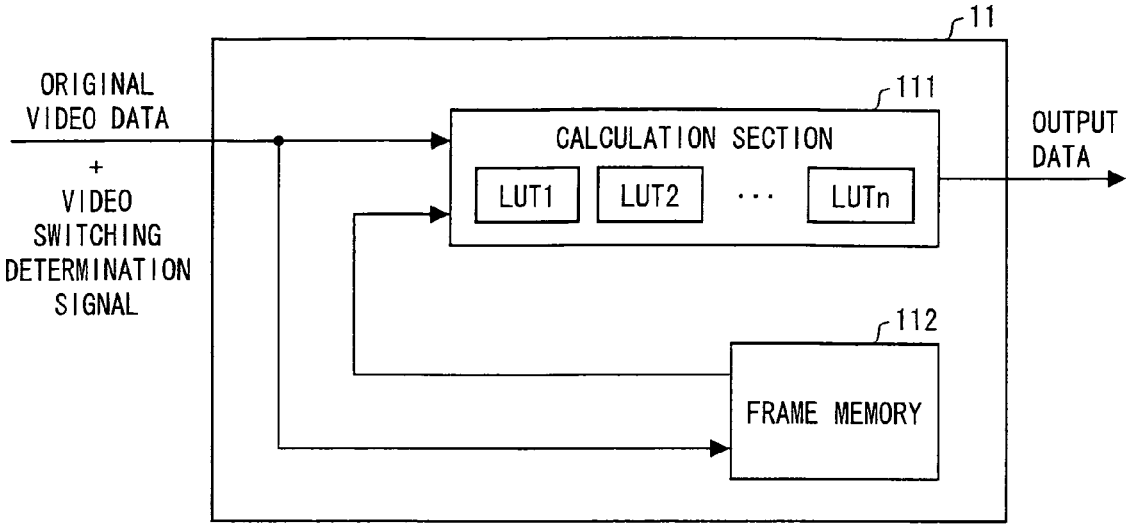
FIG. 1, showing an embodiment of the present invention, is a block diagram illustrating a configuration of a high speed moving image processing section of Embodiment 1.

The high speed moving image processing section 11 of FIG. 1 includes a calculation section 111 and a frame memory 112. First, the calculation section 111 receives the video data signal and the video switching determination signal from the host device 2. Further, the frame memory 112 receives the video data signal. The frame memory 112 maintains the inputted video data signal for a single frame period (that is, until a subsequent frame video data signal is inputted).

The calculation section 111 is a processing section which carries out data conversion for performing overshoot drive and includes a plurality of LUTs (Look-Up Tables). In the overshoot drive, a voltage higher than a writing voltage corresponding to a gray scale to be displayed is applied to each pixel. The applied voltage appropriate for the overshoot drive is determined generally in accordance with a variation of a gray scale value which variation is found by comparing video data of the current frame with video data of the previous frame. Thus, the frame memory 112 maintains the video data of the previous frame so as to carry out the aforementioned comparison. Note that, in the present embodiment, plural writing operations are carried out during a single frame period, so that a period taken to carry out a single writing operation is regarded as a sub frame, and in principle, video data of a current sub frame and video data of a previous sub frame are compared with each other so as to determine the applied voltage for performing overshoot drive.

The calculation section 111 compares video data of the current sub frame which video data is to be inputted with video data of the previous sub frame which video data is kept in the frame memory 112, so as to determine converted video data. The LUT is used for the data conversion. Specifically, a gray scale value of the current sub frame data and a gray scale value of the previous sub frame data are inputted to the LUT, and a corresponding applied voltage (actually, a gray scale value corresponding to the applied voltage) is read out from the LUT and is outputted.

The high speed moving image processing section 11 of FIG. 1 carries out writing with respect to the liquid crystal panel n times and performs overshoot with respect to every writing carried out n times. In this case, the calculation section 111 includes n number of LUTs, i.e., LUT1 to LUTn.

That is, in the aforementioned operations, the video data of the current sub frame and the video data of the previous sub frame do not change throughout n number of writing operations carried out in the same frame. However, in the second and subsequent writing operations carried out in the same frame, a voltage with which each pixel is charged and orientation of liquid crystal molecules change due to the previous writing operation, so that the optimal applied voltage for performing overshoot drive varies every time the writing is carried out. In the configuration of the high speed moving image processing section 11 of FIG. 1, the LUT is switched every time the writing operation is carried out in the same frame, thereby determining an optimal applied voltage in every overshoot drive carried out in every writing operation. Further, the LUT is switched in accordance with the video switching determination signal inputted at the same time as the input of the video data signal.

Note that, the calculation section 111 counts the number of times the writing is carried out in every writing operation in a single frame and selects, from LUT1 to LUTn, an LUT in accordance with the counted number of times. Further, the video data signal transmitted from the host device 2 is refreshed every time a new frame starts, and an image switching signal is inputted from the host device 2 in response to this refreshing operation. The calculation section 111 resets the counted number in response to the image switching signal, and the first LUT1 is used again.

Figure 3:
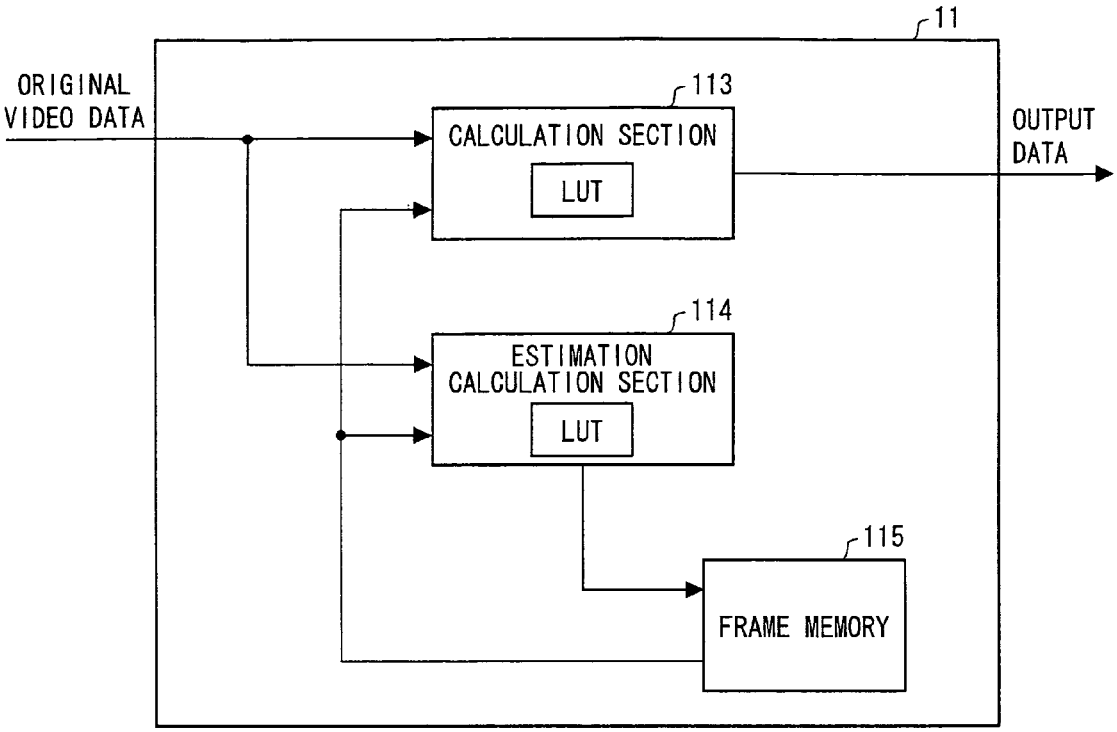
FIG. 3, showing an embodiment of the present invention, is a block diagram illustrating a configuration of the high speed moving image processing section of Embodiment 1.

Next, FIG. 3 illustrates a modification example of the high speed moving image processing section 11. The high speed moving image processing section 11 of FIG. 3 includes a calculation section 113, an estimation calculation section 114, and a frame memory 115. First, a video data signal is inputted from the host device 2 to the calculation section 113 and the estimation calculation section 114. Further, a video data signal calculated by the estimation calculation section 114 is inputted to the frame memory 115. The frame memory 115 maintains the video data signal, inputted from the estimation calculation section 114, until a subsequent video data signal is inputted.

The calculation section 113 is a processing section which carries out data conversion for performing overshoot drive and includes an LUT (Look-Up Table) for carrying out the data conversion process. In response to the video data signal inputted from the host device 2 and a video data signal stored in the frame memory 115, a corresponding applied voltage (actually, a gray scale value corresponding to the applied voltage) is read out and is outputted from the LUT of the calculation section 113.

The calculation section 113 does not switch the LUT unlike the configuration illustrated in FIG. 1. Further, the video data of the current sub frame does not change throughout the n number of writing operations carried out in the same frame. Thus, in order to apply an optimal voltage in every overshoot drive performed in the same frame, it is necessary to appropriately update the video data of the previous sub frame, which video data is compared with the video data of the current sub frame, every time the writing operation is carried out. In the configuration of the high speed moving image processing section 11 illustrated in FIG. 3, the estimation calculation section 114 serves as a processing section for updating the video data of the previous sub frame.

That is, the estimation calculation section 114 includes an LUT (Look-Up Table) as in the calculation section 113. In response to the video data signal (corresponding to the video data of the current sub frame) inputted from the host device 2 and the video data signal (corresponding to the video data of the previous sub frame) stored in the frame memory 115, a gray scale value achieved in each pixel at the time of the subsequent writing operation is read out and is outputted from this LUT. That is, the estimation calculation section 114 estimates a gray scale value, which will be achieved in each pixel at the time of the subsequent writing operation, every time the writing operation is carried out with respect to the liquid crystal panel 14, and updates the video data signal, based on the estimated gray scale, in the frame memory 115.

Thus, in the calculation section 113, the video data signal of the previous sub frame which video data signal is stored in the frame memory 115 is updated every time the writing operation is carried out, so that it is possible to determine an optimal applied voltage in every overshoot drive performed at the time of the writing operation.

Embodiment 2

In Embodiment 1, the n number of writing operations are carried out with respect to the LCD panel 14 during a single frame period, and the host device 2 transmits data to the liquid crystal display device 1 n times in a single frame in response to the n number of writing operations. In this case, it is necessary to transmit data from the host device 2 to the liquid crystal display device with high speed. This results in a higher power consumption for the data transmission.

Embodiment 2 describes a case where video data is transmitted from the host device 2 to the liquid crystal display device 1 once in a single frame. Note that, a schematic configuration of the liquid crystal display device according to Embodiment 2 is the same as that illustrated in FIG. 2.

Figure 4:
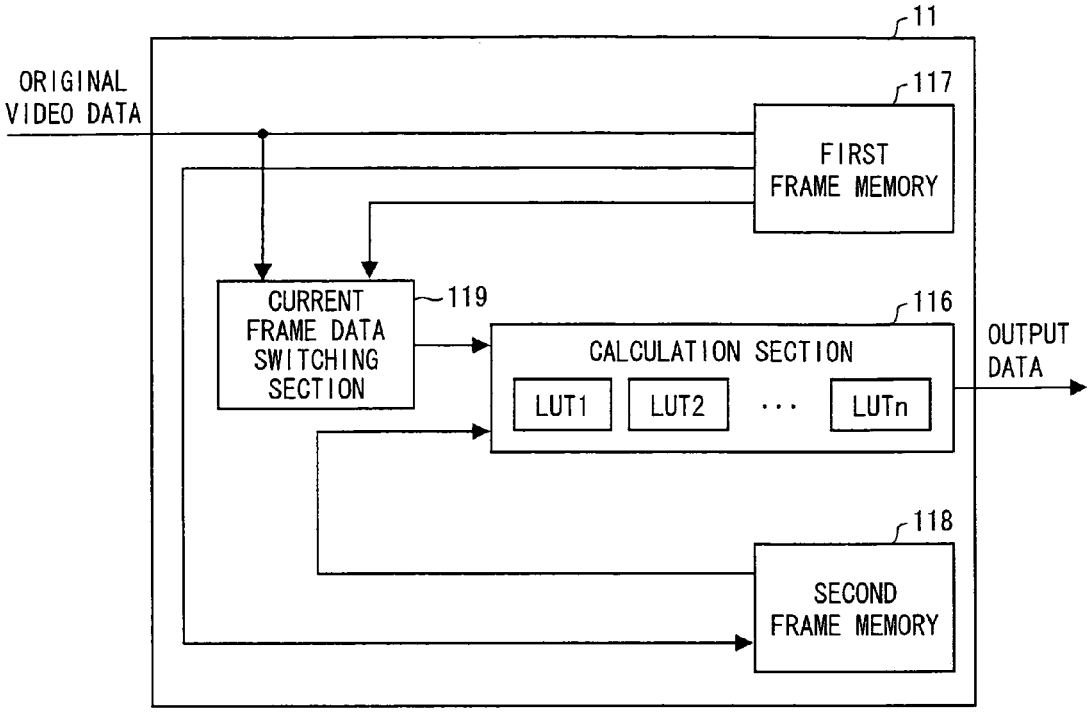
FIG. 4, showing an embodiment of the present invention, is a block diagram illustrating a configuration of a high speed moving image processing section of Embodiment 2.

With reference to FIG. 4, a configuration and operation of a high speed moving image processing section 11 according to Embodiment 2 are detailed as follows.

The high speed moving image processing section 11 of FIG. 4 includes a calculation section 116, a first frame memory 117, a second frame memory 118, and a current frame data switching section 119. A video data signal of a current frame which video data signal is inputted from the host device 2 is inputted to the first frame memory 117 and the current frame data switching section 119. At this time, the video data signal having been stored in the first frame memory 117 is sent to the second frame memory 118 and is maintained in the second frame memory 118. That is, in each frame, current frame data is maintained in the first frame memory 117, and previous frame data is maintained in the second frame memory 118.

In the configuration of the high speed moving image processing section 11 illustrated in FIG. 4, a video data signal inputted from the host device 2 is inputted to the calculation section 116 via the current frame data switching section 119 as video data of a current sub frame and video data signal having been stored in the first frame memory 117 is inputted to the calculation section 116 via the current frame data switching section 119 as video data of a previous sub frame when a first writing operation in a certain frame is carried out. At this time, the video data signal inputted from the host device 2 is inputted to the first frame memory 117, so that data stored in the first frame memory 117 is updated. Further, the video data signal having been stored in the first frame memory 117 is inputted to the second frame memory 119, so that data stored in the second frame memory 118 is updated. The calculation section 116 carries out data conversion for performing overshoot drive by using an LUT1. This LUT1 is the same as the LUT1 of FIG. 1.

In Embodiment 2, the video data signal is transmitted from the host device 2 to the liquid crystal display device 1 only once in the first writing operation in a single frame. This video data is transmitted in accordance with a speed at which writing of the LCD panel 14 is carried out, and when the second and subsequent writing operations are carried out, transmission of the video data from the host device 2 to the liquid crystal display device 1 is stopped, so that the power consumption is reduced.

Next, when the second and subsequent writing operations are carried out in a certain frame, the video data signal having been stored in the first frame memory 117 is inputted to the calculation section 116 as video data of a current sub frame, and the video data signal having been stored in the second frame memory 118 is inputted to the calculation section 116 as video data of a previous sub frame. At this time, the calculation section 116 switches the LUT every time the writing operation is carried out so as to carry out data conversion for performing overshoot drive by using any one of the LUT2 to LUTn. These LUT2 to LUTn are the same as the LUT2 to LUTn of FIG. 1.

Figure 5:
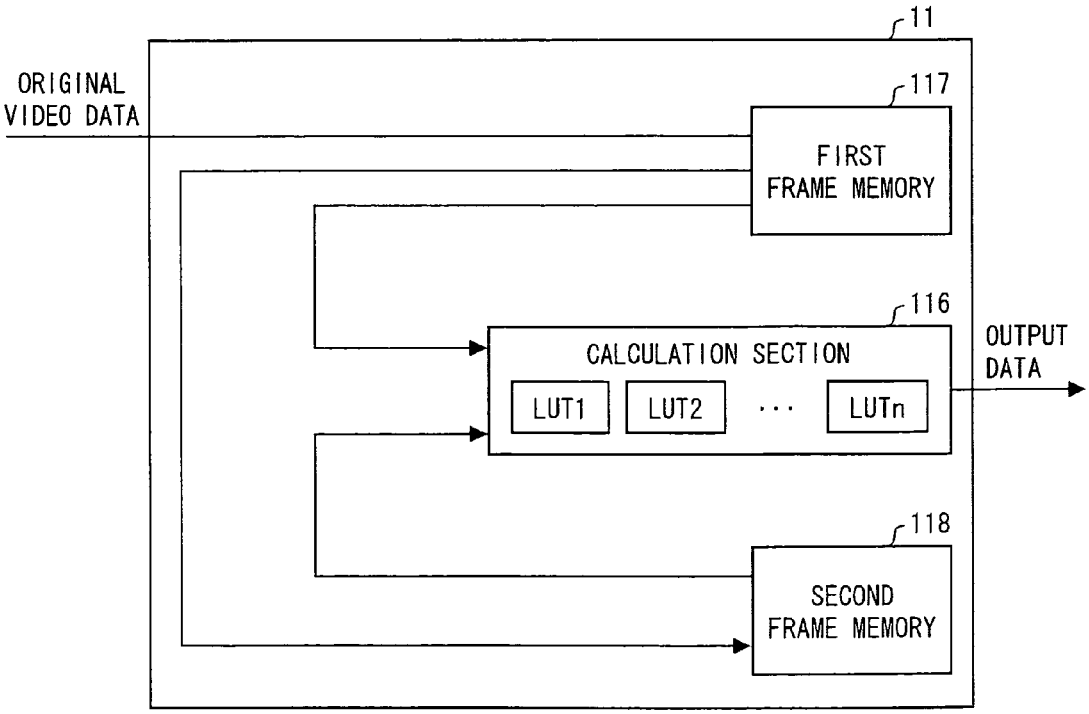
FIG. 5, showing an embodiment of the present invention, is a block diagram illustrating a configuration of the high speed moving image processing section of Embodiment 2.

FIG. 5 illustrates a modification example of the high speed moving image processing section 11 of FIG. 4. The high speed moving image processing section 11 of FIG. 5 is configured so that the current frame data switching section 119 is omitted from the configuration illustrated in FIG. 4. In this case, also in the first writing operation in a certain frame, the video data signal inputted from the host device 2 is sent to a developing section 116 after being temporarily stored in the first frame memory 117. Likewise, also in the first writing operation in a certain frame, the video data signal having been stored in the second frame memory 118 is inputted to the calculation section 116 as video data of a previous sub frame.

Figure 6:
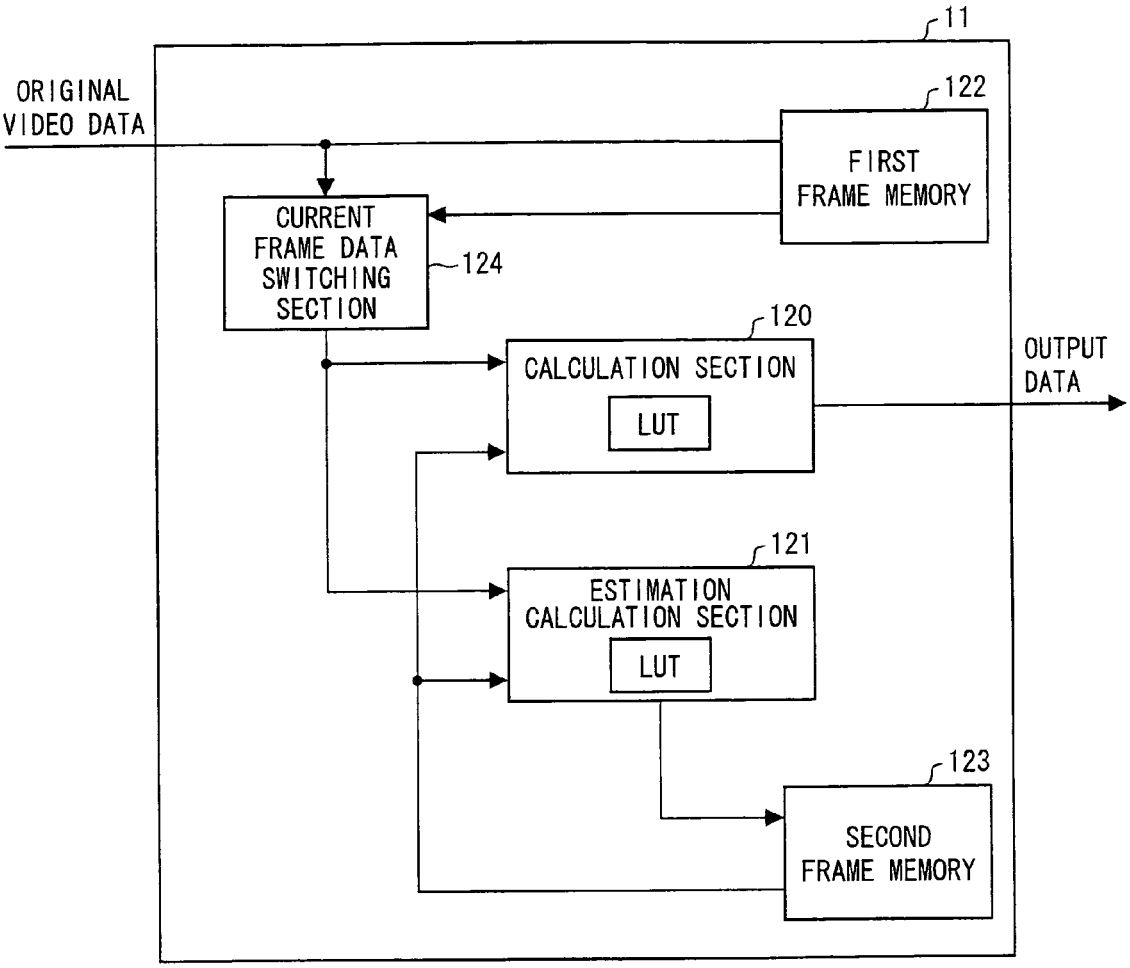
FIG. 6, showing an embodiment of the present invention, is a block diagram illustrating a configuration of the high speed moving image processing section of Embodiment 2.

Next, FIG. 6 illustrates a modification example of the high speed moving image processing section 11 of Embodiment 2. The high speed moving image processing section 11 of FIG. 6 includes a calculation section 120, an estimation calculation section 121, a first frame memory 122, a second frame memory 123, and a current frame data switching section 124. The calculation section 120 is a processing section which carries out data conversion for performing overshoot drive and includes an LUT (Look-Up Table) for carrying out the data conversion process. Further, the estimation calculation section 121 estimates a gray scale value of each pixel, which gray scale value will be achieved in a next writing operation, every time a writing operation is carried out with respect to the liquid crystal panel 14, so as to update a video data signal, based on the estimated gray scale value, in the second frame memory 123.

In the configuration of the high speed moving image processing section 11 of FIG. 6, at the time of the first writing operation in a certain frame, a video data signal inputted from the host device 2 is inputted to the calculation section 120 via the current frame data switching section 124 as video data of a current sub frame and a video data signal having been stored in the second frame memory 123 is inputted to the calculation section 120 as video data of a previous sub frame. The calculation section 120 uses an LUT so as to carry out data conversion for performing overshoot drive. This LUT is the same as the LUT of the calculation section 113 of FIG. 3.

Likewise, at the time of the first writing operation in a certain frame, the estimation calculation section 121 receives the video data signal, inputted from the host device 2, via the current frame data switching section 124 as video data of a current sub frame, and receives the video data, having been stored in the second frame memory 123, as video data of a previous sub frame. The estimation calculation section 121 estimates a gray scale value of each pixel, which gray scale value will be achieved in a next writing operation, in accordance with an LUT. This LUT is the same as the LUT of the estimation calculation section 114 of FIG. 3.

Next, in the second and subsequent writing operations in a certain frame, a video data signal having been stored in the first frame memory 122 is inputted to the calculation section 120 via the current frame data switching section 124 as video data of a current sub frame, and a video data signal having been stored in the second frame memory 123 is inputted to the calculation section 120 as video data of a previous sub frame.

As a result of the foregoing operations, the estimation calculation section 121 estimates a gray scale value of each pixel, which gray scale value will be achieved in a next writing operation, every time the writing operation is carried out with respect to the liquid crystal panel 14, so as to update a video data signal, based on the estimated gray scale value, in the second frame memory 123. Thus, in the calculation section 120, the video data signal of the previous sub frame, which video data signal has been stored in the second frame memory 123, is updated every time the writing operation is carried out, so that it is possible to determine an optimal applied voltage in every overshoot drive performed in every writing operation.

Figure 7:
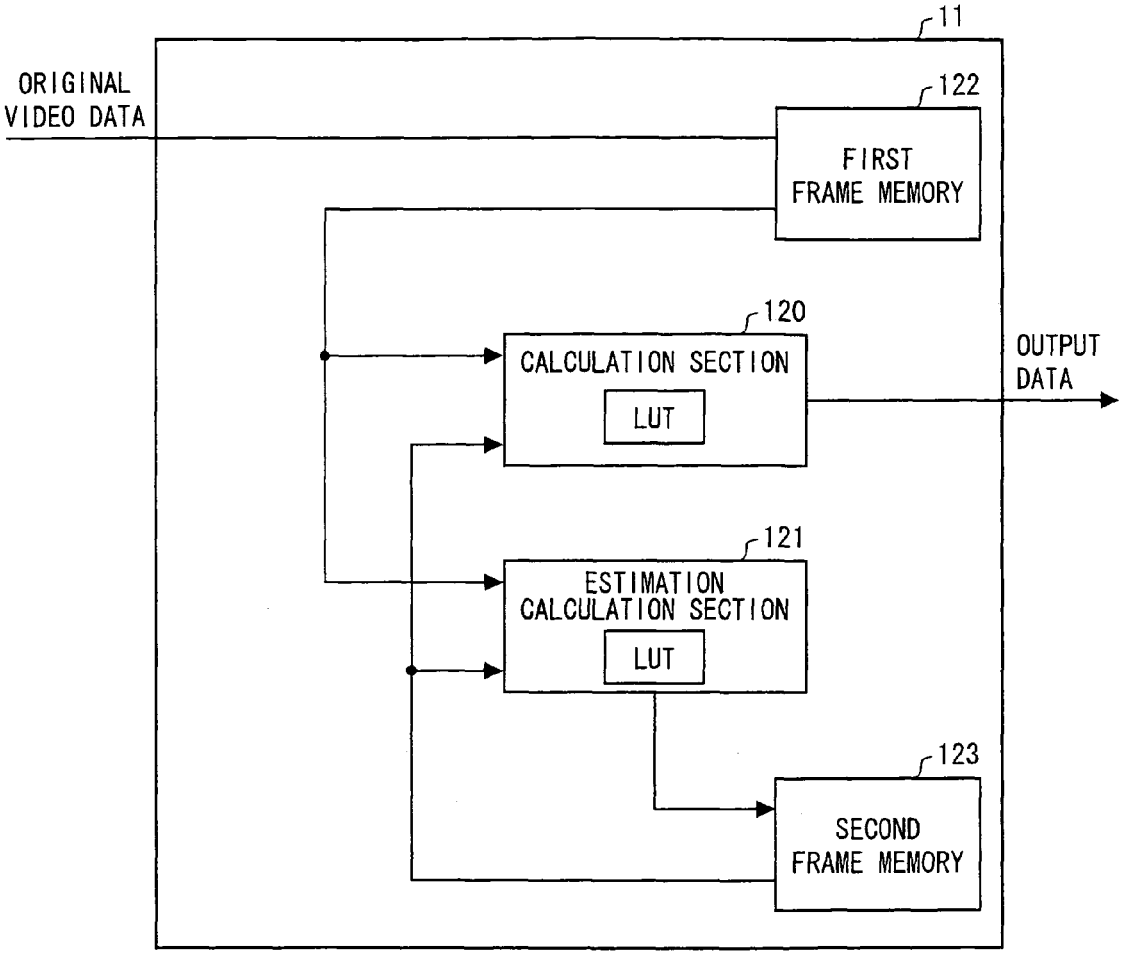
FIG. 7, showing an embodiment of the present invention, is a block diagram illustrating a configuration of the high speed moving image processing section of Embodiment 2.

FIG. 7 illustrates a modification example of the high speed moving image processing section 11 of FIG. 6. The high speed moving image processing section 11 of FIG. 7 is configured so that the current frame data switching section 124 is omitted from the configuration illustrated in FIG. 6. In this case, also in the first writing operation in a certain frame, video data inputted from the host device 2 is sent to the calculation section 120 after being temporarily stored in the first frame memory 122.

Note that, according to the configuration illustrated in FIG. 7, it is possible to adjust a variation of a data transmission/reception speed by adjusting a memory size of the first frame memory 122. Specifically, when the number of writing operations in a single frame is n ($n \geq 2$), a memory size of the first frame memory 122 is $2(n-1)/n$ times as large as data corresponding to a single frame.

Embodiment 3

In Embodiment 2, data is transmitted from the host device 2 to the liquid crystal display device 1 only once in a single frame thereby carrying out the writing with respect to the LCD panel 14 n times in a single frame period. However, in Embodiment 2, two frame memories are required in the high speed moving image processing section 11. The number of memories increases, which results in higher cost.

Embodiment 3 describes a case where video data is transmitted from the host device 2 to the liquid crystal display device 1 only once in a single frame and a single frame memory is used. Note that, a schematic configuration of the liquid crystal display device according to Embodiment 3 is the same as that illustrated in FIG. 2.

Figure 8:
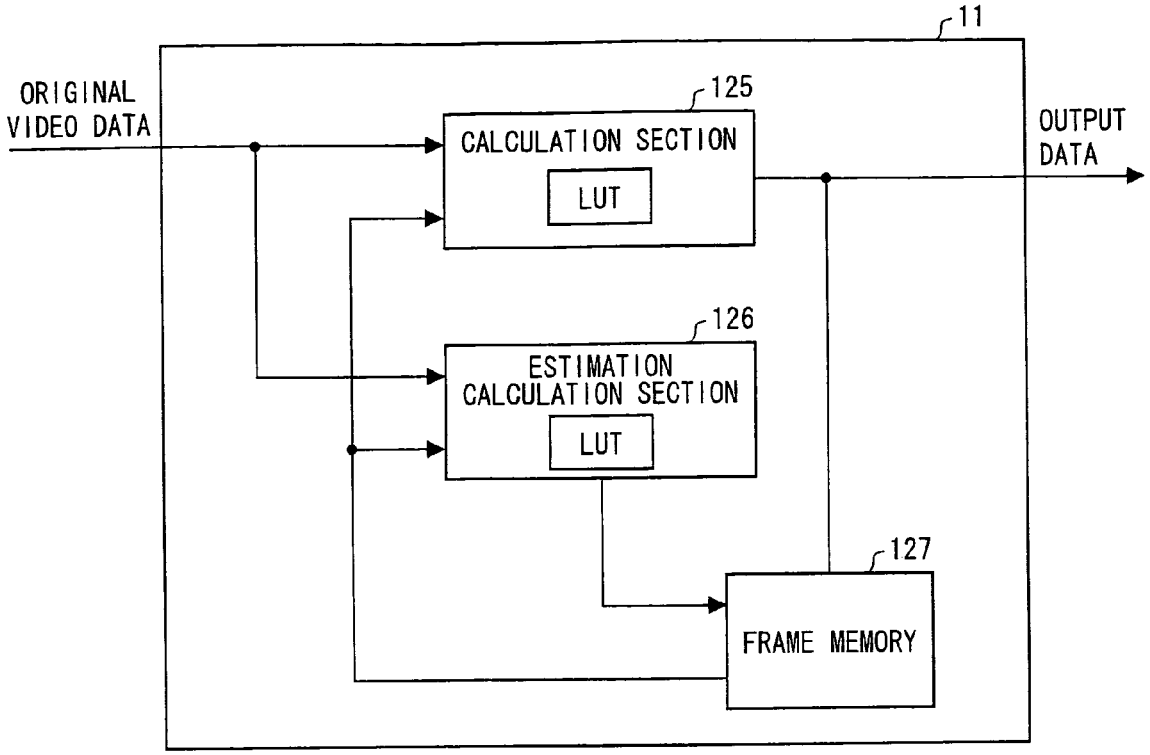
FIG. 8, showing an embodiment of the present invention, is a block diagram illustrating a configuration of a high speed moving image processing section of Embodiment 3.

With reference to FIG. 8, a configuration and operation of a high speed moving image processing section 11 according to Embodiment 3 are described as follows.

The high speed moving image processing section 11 of FIG. 8 includes a calculation section 125, an estimation calculation section 126, and a frame memory 127. A video data signal of a current frame, which video data signal is inputted from the host device 2, is inputted to the calculation section 125 and the estimation calculation section 126.

In the configuration of the high speed moving image processing section 11 of FIG. 8, at the time of the first writing operation in a certain frame, a video data signal inputted from the host device 2 is inputted to the calculation section 125 and the estimation calculation section 126 as video data of a current sub frame. Further, a video data signal stored in the frame memory 127 is inputted to the calculation section 125 and the estimation calculation section 126 as video data of a previous sub frame.

The calculation section 125 uses an LUT so as to carry out data conversion for performing overshoot drive. This LUT is the same as the LUT of the calculation section 113 of FIG. 3. In the first writing operation, an applied voltage (actually, a gray scale value corresponding to the applied voltage) calculated by the calculation section 125 is outputted.

On the other hand, in the second and subsequent writing operations in a certain frame, a video data signal is not inputted from the host device 2, and data corresponding to video data of a current sub frame is not stored in the frame memory, so that the calculation section 125 cannot carry out the calculation. Thus, in the second and subsequent writing operations, a video data signal stored in the frame memory 127 is outputted to the LCD panel 14.

Here, the video data signal stored in the frame memory 127 is a video data signal calculated by the estimation calculation section 126 in the first writing operation. The estimation calculation section 126 estimates an applied voltage (actually, a gray scale voltage corresponding to the applied voltage) which allows a desired gray scale value to be finally obtained when the overshoot drive is performed by using a single applied voltage at the time of the second to n-th writing operations, where n is the number of writing operations in a single frame. In the estimation calculation section 126, the aforementioned estimation calculation is carried out by using an LUT, and a video data signal obtained as a result of the calculation is stored in the frame memory 127.

The liquid crystal display device 1 according to Embodiments 1 through 3 carries out the writing n times in a single frame and carries out black insertion display. Further, the black insertion display is carried out by entirely controlling ON/OFF of a back light. With reference to (a) and (b) of FIG. 9, the following describes an example of a relationship between the writing operations carried out with respect to the LCD panel 14 and the control of the back light in the liquid crystal display device 1.

Figure 9:
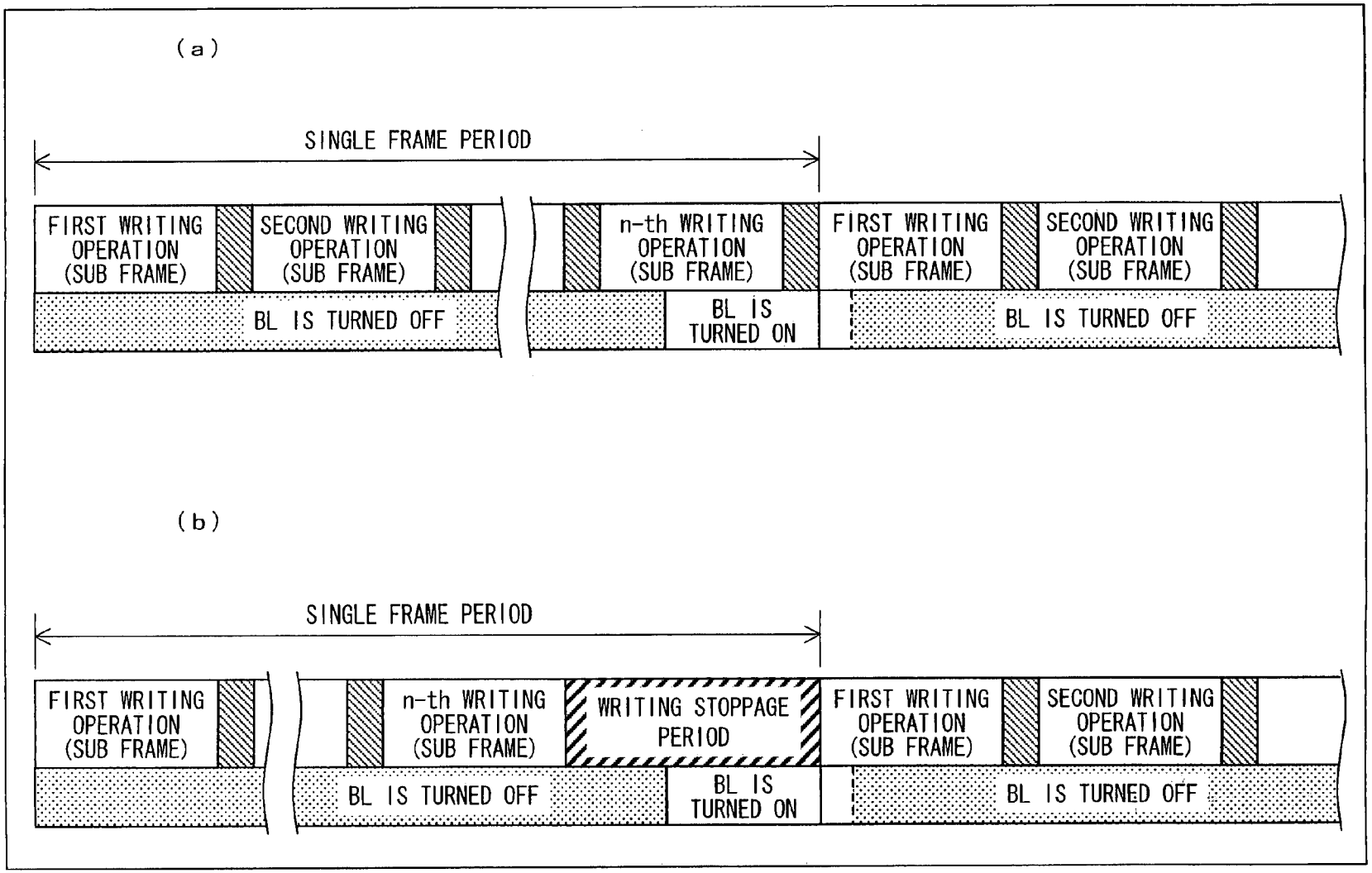
FIG. 9 Each of (a) and (b) illustrates a relationship between writing operations in an LCD panel of a liquid crystal display device and control of a backlight.

In both (a) and (b) of FIG. 9, the writing is carried out n times in a single frame. In (a) of FIG. 9, the writing is carried out n times by using the single frame entirely, but in (b) of FIG. 9, a period in which the writing is stopped (writing stoppage period) is provided in part of the single frame and the writing is carried out n times in other period.

In the operations of (a) of FIG. 9, a period from the first writing operation to a part of the n-th writing operation is a black display period (i.e., a BL turned-off period), and a period from the part of the n-th writing operation to the end of the frame is an image display period (i.e., a BL turned-on period). In this configuration, the writing is carried out by using the single frame entirely, so that a liquid crystal response time can be kept long in each writing period, and display can be optimized. Particularly, as "n" is larger, it is possible to more favorably control the display.

While, in the operations of (b) of FIG. 9, a period from the first writing operation to a part of the writing stoppage period is a black display period (i.e., a BL turned-off period), and a period from the part of the writing stoppage period to the end of the frame is an image display period (i.e., a BL turned-on period). In this configuration, the writing stoppage period is provided, thereby reducing power consumption.

Note that, in both (a) and (b) of FIG. 9, the end of the image display period corresponds to the end of the frame, but the present invention is not limited to this, and the end of the image display period may correspond to a first writing period of a next frame.

A liquid crystal display device, carrying out such display that a single frame period includes a black display period and an image display period and carrying out writing into a liquid crystal panel n times (n≥2) during the single frame period, said liquid crystal display device comprising:

a calculation section including a plurality of LUTs in accordance with which an output for performing overshoot drive is obtained with reference to current frame data and previous frame data;

a first memory in which a video data signal of a current frame is stored; and a second memory in which a video data signal of a previous frame is stored, wherein during a first writing period in a single frame period, the calculation section carries out data conversion for performing the overshoot drive by using a video data signal, transmitted from a host device, as the current frame data, and by using the video data signal, read out from the first memory, as the previous frame data, and data read out from the first memory is stored into the second memory, and during second and subsequent writing periods in the single frame period, the calculation section carries out data conversion for performing the overshoot drive by using the video data signal, read out from the first memory, as the current frame data, and by using a video data signal, read out from the second memory, as the previous frame data, and the data conversion for performing the overshoot drive is carried out in accordance with an LUT which is switched in every writing period.

A liquid crystal display device, carrying out such display that a single frame period includes a black display period and an image display period and carrying out writing into a liquid crystal panel n times (n≥2) during the single frame period, said liquid crystal display device comprising:

a calculation section including an LUT in accordance with which an output for performing overshoot drive is obtained with reference to current frame data and previous frame data;

an estimation calculation section for estimating a gray scale of each pixel, which gray scale will be achieved after each writing period, based on the current frame data and the previous frame data;

a first memory in which a video data signal of a current frame is stored; and a second memory in which data calculated by the estimation calculation section is stored, wherein during a first writing period in a single frame period, the calculation section carries out data conversion for performing the overshoot drive by using a video data signal, transmitted from a host device, as the current frame data, and by using the video data signal, read out from the first memory, as the previous frame data, and the estimation calculation section estimates the gray scale by using the video data signal, transmitted from the host device, as the current frame data, and by using the video data signal, read out from the first memory, as the previous frame data, and during second and subsequent writing periods in the single frame period, the calculation section carries out data conversion for performing the overshoot drive by using the video data signal, read out from the first memory, as the current frame data, and by using a video data signal, read out from the second memory, as the previous frame data, and the estimation calculation section estimates the gray scale by using the video data signal, read out from the first memory, as the current frame data, and by using the video data signal, read out from the second memory, as the previous frame data.

A display device, comprising any of the liquid crystal display devices as set forth previously; and a host device for transmitting a video data signal to the liquid crystal display device, wherein the host device transmits the video data signal to the liquid crystal display device once in a single frame.

The display device as set forth above, wherein the host device transmits the video data signal to the liquid crystal display device in accordance with speed of the writing and stops transmitting the video data signal during other period.

The invention claimed is:

1. A method for driving a liquid crystal display device, carrying out such display that a single frame period includes a black display period and an image display period and carrying out writing into a liquid crystal panel 'n' times (n≥2) during the single frame period, said liquid crystal display device comprising:

a calculation section including a plurality of lookup tables (LUTs) in accordance with which an output for performing overshoot drive is obtained with reference to current frame data and previous frame data;

a first memory in which a video data signal of a current frame is stored; and a second memory in which a video data signal of a previous frame is stored, the method comprising:

during a first writing period in a single frame period, the calculation section carrying out data conversion for performing the overshoot drive by using a video data signal, transmitted from a host device, as the current frame data, and by using the video data signal, read out from the first memory, as the previous frame data, and data read out from the first memory is stored into the second memory; and during second and subsequent writing periods in the single frame period, the calculation section carrying out data conversion for performing the overshoot drive by using the video data signal, read out from the first memory, as the current frame data, and by using a video data signal, read out from the second memory, as the previous frame data, and the data conversion for performing the overshoot drive being carried out in accordance with an LUT which is switched in every writing period.

* * * * *